US006390405B1

(12) United States Patent
Bissonnette et al.

(10) Patent No.: US 6,390,405 B1
(45) Date of Patent: May 21, 2002

(54) GOLF BALL WINDING APPARATUS AND METHOD

(75) Inventors: Laurent Bissonnette, Portsmouth, RI (US); Emanuel Vieira, New Bedford, MA (US); Roman D. Halko, Natick, MA (US); Walter L. Reid, Jr., Mattapoisett, MA (US)

(73) Assignee: Acushnet Company, Fairhaven, MA (US)

( * ) Notice: Subject to any disclaimer, the term of this patent is extended or adjusted under 35 U.S.C. 154(b) by 28 days.

(21) Appl. No.: 09/610,607

(22) Filed: Jul. 5, 2000

(51) Int. Cl.[7] ..... B65H 54/64
(52) U.S. Cl. ..... 242/435.1
(58) Field of Search ..... 242/435, 435.1, 242/435.2

(56) References Cited

U.S. PATENT DOCUMENTS

| | | | | | |
|---|---|---|---|---|---|
| 1,435,771 | A | | 11/1922 | White et al. | |
| 1,662,003 | A | * | 3/1928 | Eldridge | 242/435.2 |
| 1,996,450 | A | | 4/1935 | Bes | 117/41 |
| 2,033,356 | A | * | 3/1936 | Pym | 242/435.1 |
| 2,153,408 | A | * | 4/1939 | Bogoslowsky | 242/435 |
| 2,153,409 | A | * | 4/1939 | Bogoslowsky | 242/435 |
| 2,161,546 | A | | 6/1939 | Honig | 242/3 |
| 2,164,336 | A | * | 7/1939 | Meyer | 242/435.1 |
| 2,179,094 | A | * | 11/1939 | Joss | 242/435.1 |
| 2,200,257 | A | | 5/1940 | Bogoslowsky | |
| 2,237,112 | A | | 4/1941 | Parvin | 242/45 |
| 2,425,909 | A | | 8/1947 | Wilhelm | 242/45 |
| 2,746,691 | A | | 5/1956 | Hoad | 242/55 |
| 2,777,545 | A | | 1/1957 | Rockett, Jr. | 188/164 |
| 2,826,375 | A | | 3/1958 | von Wehrden | 242/75.51 |
| 3,288,382 | A | | 11/1966 | Dunn | 242/2 |
| 4,580,742 | A | | 4/1986 | Moosberg et al. | 242/84.52 B |
| 4,783,078 | A | | 11/1988 | Brown et al. | 273/216 |
| 4,846,910 | A | * | 7/1989 | Brown | 242/435 |
| 4,946,115 | A | | 8/1990 | Muller | 242/289 |
| 5,007,594 | A | | 4/1991 | Brown | 242/3 |
| 5,133,509 | A | | 7/1992 | Brown | 242/3 |
| 5,400,876 | A | | 3/1995 | Duncan | 188/158 |
| 5,626,308 | A | | 5/1997 | Fukazawa | 242/435.2 |
| 5,685,785 | A | | 11/1997 | Kakiuchi et al. | 473/354 |
| 5,697,574 | A | | 12/1997 | Miyakoshi et al. | 242/435.2 |
| 5,755,628 | A | | 5/1998 | Kakiuchi et al. | 273/354 |
| 6,290,610 | B1 | * | 9/2001 | Reid, Jr. et al. | 473/357 |

* cited by examiner

*Primary Examiner*—Emmanuel M. Marcelo
(74) *Attorney, Agent, or Firm*—Swidler Berline Shereff Friedman, LLP

(57) ABSTRACT

The present invention is directed to a winding apparatus and method for winding a thread on a golf ball center. The apparatus comprises a plurality of rotating members supported for rotation and guiding the thread to a golf ball center winding station. The sum of the rotational inertias of the rotating members is low or less than about 3000 grams-cm$^2$. The apparatus further includes a roller and at least one brake operatively connected with the roller for changing the rotation thereof. The brake can be a magnetic brake and include a permanent magnet or an electro-magnet. The method of the present invention allows the tension to be changed by applying a magnetic force to at least one roller. In one embodiment, the step of changing the tension includes using a magnetic brake. The present invention is particularly useful in winding thread with a breaking tension below about 800 grams.

23 Claims, 4 Drawing Sheets

GOLF BALL WINDING APPARATUS AND METHOD

FIELD OF THE INVENTION

The present development relates to a golf ball, and more particularly, to a golf ball winding apparatus with low combined rotary inertia.

BACKGROUND OF THE INVENTION

At the present time, wound golf balls remain the preferred golf ball of the more advanced player due to spin and feel characteristics. Wound golf balls typically have either a spherical solid rubber or fluid-filled center around which many yards of a stretched elastic thread are wound forming a wound core. The wound core is then covered with a durable cover material, such as a SURLYN®, which is a trademark for an ionomer resin produced by DuPont de Nemours & Company, or similar material or a softer cover, such as Balata or polyurethane. Wound balls are generally softer and provide more spin, which enables a skilled golfer to have more control over the ball's flight and position. Particularly, with approach shots onto the green, the high spin rate of soft, wound balls enables the golfer to stop the ball very near its landing position.

The threads wound about the center of the golf ball are usually stretched as tightly as possible without subjecting them to unnecessary incidents of breakage. The reason for this is that the tighter the threads are wound, the more lively the ball. The consequence of this is a relatively high compression for the ball and a relatively high initial velocity.

The threads wound about golf balls frequently contain weak points because of impurities and other imperfections. Because of this, most manufacturers of wound golf balls do not try to wind using the maximum tension or maximum elongation of a thread. Additionally, most manufacturers do not generally use below 85% of the maximum elongation.

From time to time thread breakages will occur even when using a winding tension that produces less than maximum elongation. When a thread breaks during manufacturing, if the winding machine does not lose control of the free end of the thread, the machine needs to be restarted. However, if the winding machine loses control of the free end of the thread, an operator must manually re-thread the machine and restart the operation. Both of these situations decrease production, and thus are undesirable.

However, when such breakages occur during play due to impact of a club face with a ball, they can result in substantially deleterious effects. There can be a substantial loss in velocity of the ball, in the ball deviating from its line of flight, and/or in the ball becoming substantially non-spherical. Such results are undesirable.

Many different apparatuses and methods for winding golf balls exist. Prior art methods utilize power, guide, and brake rollers to feed, orient and tension thread as it is applied to a golf ball center. Prior art winding technology cannot wind threads with low breaking tension in a production environment because the threads break too often. Thread tension varies during the winding procedure, where the initial or start-up tension is typically different than the running tension of the thread during winding and thread breakages can occur throughout the winding procedure.

It is known that a high percentage of thread breaks occur during the initial start-up of winding. During initial start-up, a thread goes from no elongation to a very high elongation over a short period of time. Under such conditions, the thread is much more likely to break. One solution which has been employed is to substantially reduce the tension applied to the thread during the initial stages of winding. Because of the reduced tension, irregularities in the thread are less likely to cause a break in the thread. Furthermore, the reduced initial tension of winding usually results in an overall reduction in breakage of the thread during the entire winding process. It still remains possible that low breaking tension threads will break even if wound at a lower initial tension. One way to wind these types of threads is to wind them slowly. However, winding at these slow speeds is unacceptable in a production environment, where winding time must be minimized.

The prior art rollers and accompanying bearings and shafts typically have high rotational inertia which can impart an initial tension on the thread during start-up greater than the breaking tension. A significant portion of thread tension during start-up is due to inertial forces that are the product of rotational acceleration and rotary inertia. Essentially, high inertia leads to high start-up tension and failure of low breaking tension thread. The initial acceleration of the rollers and shafts can be reduced to prevent thread fracture but slow production rates and poor tension control results. Further complicating matters is the fact that when initiating ball winding, these rollers and shafts typically must accelerate up to winding velocity in less than 5 seconds in order to achieve satisfactory manufacturing results.

Thread breakage can also occur when additional tension is applied to the thread during the winding process. Initially, the majority of the tension is due to the rotational inertia of the rollers as they start from rest and accelerate up to winding speeds. Once winding speed is reached, the tension applied to the thread is increased due to differential rotating velocities of the rollers that the thread traverses, or other tensioning devices which actively tension the thread. The thread will break if the additional tension applied is greater than the breaking tension of the thread.

Prior art apparatuses use frictional brake systems and controlled differential drive systems to apply additional tension to the thread during winding. These systems have wearing parts and commonly need frequent calibration and adjustment due to wear and environmental variations such as those caused by lubricants. Winding at low tension puts a greater premium on the repeatability of the systems and the ability to maintain consistent torque, therefore making it more critical that the systems are properly calibrated. Even when properly calibrated, these systems result in poor tension control at slow winding rates and therefore create golf balls with less uniform thread tension than is desired. Also, prior art winding machines that rely on differential drive systems to induce tension require substantial thread elongation to effect tension control and are costly. Furthermore, these systems present a complex control problem during the start-up phase where desired tension may not be attained instantaneously, and if they are engaged during the initial start-up winding process, additional inertia is added to the overall apparatus, making it more likely for a low breaking tension thread to break.

Therefore, it would be advantageous to provide an apparatus for winding threads with low breaking tension at speeds that are acceptable in a production environment.

SUMMARY OF THE INVENTION

The present invention is directed to a winding apparatus for winding a thread on a golf ball center. The apparatus comprises a plurality of rollers supported for rotation and guiding the thread to a golf ball center winding station. The sum of the rotational inertias of all rotating members (i.e., rollers, shafts, and bearings) is low and less than about 3000 or more preferably less than about 1500 grams-cm$^2$.

In one embodiment, the sum of the rotational inertias of the rotating members is less than about 800 grams-cm$^2$. In another embodiment, the sum of the rotational inertias of the rotating members is less than about 200 grams-cm$^2$.

In yet another embodiment, the plurality of rotating members includes at least one tension roller for elongating the thread. In one embodiment, the tension rollers are made of a material with a density less than about 8 g/cm$^3$. The tension rollers can be less than about 4.0 inches in diameter and less than about 0.5 inches thick. At least one tensioning device is operatively connected with one of the tension rollers for adjusting the tension roller. In one embodiment, the tensioning device is a frictional brake. In another embodiment, the tensioning device is a magnetic brake. The magnetic brake can include a permanent magnet or an electro-magnet.

In another embodiment, the tensioning device comprises a second roller adjacent the tension roller configured to elongate the thread between the tension roller and second roller, and the tension roller is rotated at a different speed than the second roller to elongate the thread.

In yet another embodiment, the rotating members further include a plurality of idler rollers. In one embodiment, the idler rollers are made of a material with a density less than about 3 g/cm$^3$. The idler rollers can be less than about 1.5 inches in diameter and less than about 0.5 inches thick. In another embodiment, the rotating members further include a sensing roller.

In addition, the present invention is directed to a winding apparatus for winding a thread on a golf ball center. The apparatus comprises a golf ball center winding station for winding a golf ball center, and a plurality of rotating members spaced from the winding station and supported for rotation and for guiding the thread to the winding station and for tensioning the thread. The rotating members include at least one tension roller and a tensioning device operatively associated with at least one tension roller. The tensioning device includes a magnetic brake that applies a non-frictional torque to at least one tension roller.

The present invention is also directed to a method of winding a golf ball comprising the steps of: providing a golf ball center; winding a thread onto a golf ball center over at least one roller; applying tension to the thread before winding onto the center; and changing the tension by applying a magnetically induced torque to at least one roller such that the torque is non-frictional with respect to the associated roller.

In one embodiment, the step of changing the tension further includes using a magnetic brake, which can include either a permanent magnet or an electro-magnet. In another embodiment, the step of applying tension further includes providing a first brake and a second brake an the first break is always operative and the second brake is selectively operative. In another embodiment, the thread has a break tension below 800 grams.

DESCRIPTION OF THE PREFERRED EMBODIMENT

Figure 1:
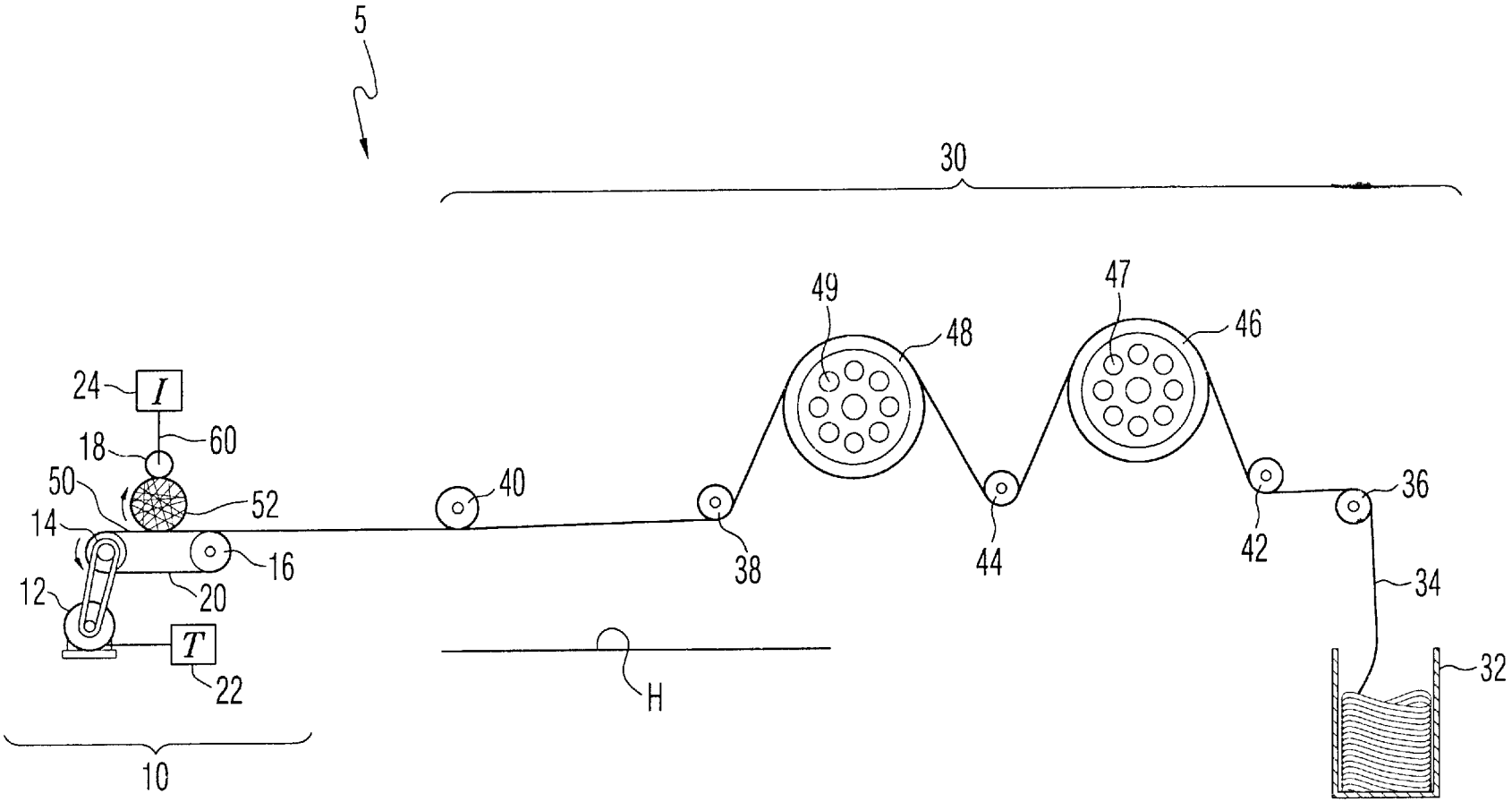
FIG. 1 is a schematic view of a golf ball winding apparatus according to the present invention.

Referring to FIG. 1, a preferred embodiment of winding apparatus 5 according to the present invention is shown. The winding apparatus 5 is designed to wind numerous types of thread or any material in the form of a continuous strand to form a wound golf ball core.

The apparatus 5 comprises a thread winding section or station 10 including a motor 12, rollers 14, 16 and 18, belt 20, timer 22, and indicator 24. The apparatus further includes a thread feed and tension section 30 including a thread supply box 32 of thread 34 and a plurality of rotating members. The rotating members include idler rollers 36, 40, and 42, tension sensing rollers 38 and 44, and tension rollers 46, 48.

Motor 12 drives roller 14 about which the rubber belt 20 is disposed. The belt 20 also travels around roller 16 before returning to roller 14. The belt 20 has a generally planar center portion 50 extending between rollers 14 and 16 to support and rotate a golf ball center 52. Roller 18 bears down on golf ball center 52 from above, while center 52 is in contact with belt 20. As the motor 12 drives the belt 20, the golf ball center 52 rotates and draws thread 34 through the thread feed and tension section 30 from the thread supply box 32.

Figure 2:
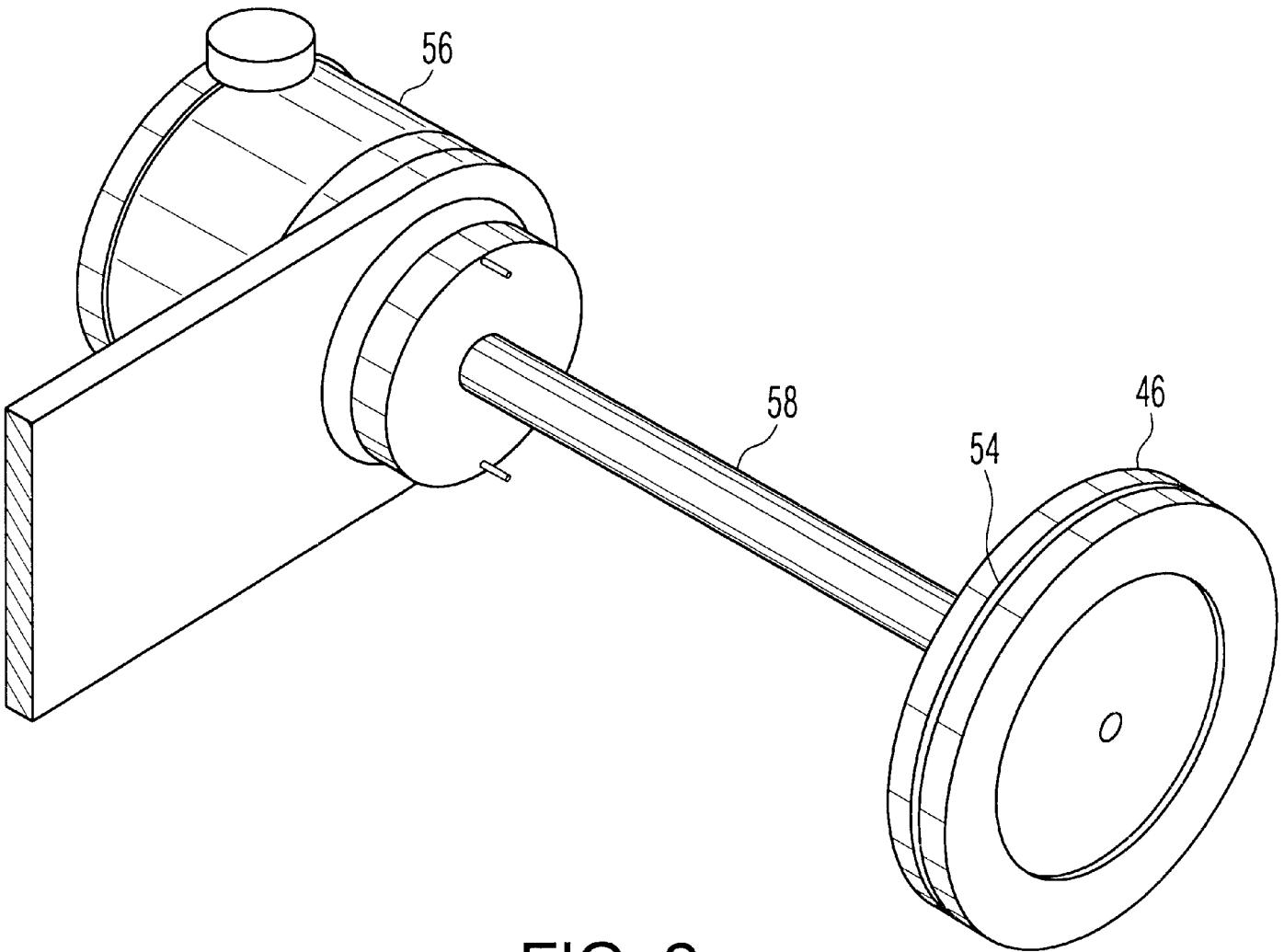
FIG. 2 is an enlarged, partial perspective view of a magnetic brake coupled to a tension roller of the apparatus shown in FIG. 1.

From the thread supply box 32, thread 34 first passes about idler rollers 36 and 42 and then travels to low tension roller 46. Low tension roller 46 defines holes 47 which extend therethrough. Low tension roller 46 has a groove 54 (shown in FIG. 2) in which thread 34 travels. Referring to FIG. 2, preferably an axle 58 is attached to low tension roller 46. Axle 58 preferably is a shaft fixed to low tension roller 46. The shaft is a solid rod or hollow tube made of, for example, metal, plastic or composite material.

A tensioning device, such as a frictional brake, is associated with low tension roller 46 to apply tension to thread 34. For example, one suitable frictional brake system is described in U.S. Pat. No. 4,783,078 issued to Brown et al. and incorporated herein by reference. Other suitable frictional brakes, including those available from Inertia Dynamics of Collinsville, Conn., or the like may also be used. Alternatively, a compressed rubber roller may also be used. For example, two rollers can be disposed adjacent each other to contact the thread and squeeze or compress the thread between the rollers. Alternatively, two rollers can be rotated with different speeds so that the thread is tensioned therebetween. Generally, any tensioning device known to those skilled in the art may be used to apply tension to thread 34.

Preferably, a magnetic brake 56 (as shown in FIG. 2) is associated with low tension roller 46 and applies a magnetically induced torque to axle 58. Brake 56 is spaced from the axle 58 and therefore does not frictionally contact the axle when magnetic force is applied thereto. The magnetic force which is applied to axle 58 by brake 56 can change the rotational torque of low tension roller 46 and will directly affect the degree of stretch of the thread 34 (as shown in FIG. 1) as it is wound onto the golf ball center 52.

Preferably, magnetic brake 56 uses a permanent magnet producing a magnetic field which provides the precise magnetic field strength necessary to produce the desired torque without the need for electrical excitation. Because the field strength produced by a permanent magnet is constant, the resulting torque will also be constant. One recommended permanent magnetic brake is available from Magnetic Technologies of Oxford, Mass., under model number 527.

Referring again to FIG. 1, after low tension roller 46, thread 34 preferably passes about tension sensing roller 44 to high tension roller 48 and then to tension sensing roller 38. Tension sensing rollers 44 and 38 measure the tension of the thread 34 and the tension may be adjusted during the winding of the ball as a function of ball diameter, time or any other predetermined parameter. Tension sensing roller 44 measures the tension of thread 34, after thread 34 passes over low tension roller 46 and before it passes over high tension roller 48. Alternatively, tension sensing roller 44 can be removed so that thread 34 passes directly from low tension roller 46 to high tension roller 48. Tension sensing roller 38 measures the tension of thread 34, after thread 34 passes over high tension roller 48.

High tension roller 48 is preferably configured similar to low tension roller 46 to define holes 49 that extend through the roller and a groove (not shown) disposed around the perimeter of roller 48 in which thread 34 travels. A tensioning device, such as those described above, is also associated with high tension roller 48 to apply tension to thread 34. Any tensioning device may be used, such as the previously described frictional brake system, compressed rubber roller mechanism, or magnetic brake so long as the device is a suitable torsional drag producing device for applying drag forces to a rotating shaft.

Preferably, high tension roller 48 is mechanically coupled to a magnetic brake by an axle similarly to low tension roller 46, as shown in FIG. 2 and discussed above. The axle is preferably substantially similar to axle 58 previously described. In order to be able to exert sufficient torque on the axle of high tension roller 48, the magnetic brake coupled thereto preferably is an electro-magnet with coils through which a current passes to induce a magnetic field about the axle and a variable braking power may be produced to tension high tension roller 48. Thus, this magnetic brake allows for the application of constant tension regardless of rotational speed of the tension roller by altering the current traveling through the coils. One such recommended magnetic brake is an electrically operated magnetic brake available from Magtrol, Inc. of Buffalo, N.Y.

After the thread 34 leaves high tension roller 48, it passes tension sensing roller 38 and idler roller 40 to the golf ball center 52. Referring to FIG. 1, golf ball center 52 is shown with some windings of thread thereabout. As the size of the golf ball core increases due to the addition of more thread thereto, roller 18 rises and rod 60 attached thereto also rises. Rod 60 can suitably be the core of a transducer which can serve as an indicator 24 of the diameter of the golf ball core. Also, a timer 22 can be used in conjunction with motor 12.

Belt planar center portion 50 is preferably parallel to a horizontal plane H. The Idler rollers 36, 40, 42, tension sensing rollers 38 and 44, and tension rollers 46 and 48 are supported for rotation in a generally coplanar relation, each having an axis of rotation parallel to horizontal plane H. Idler rollers 38, 40, 42 and tension sensing roller 44 are supported for rotation in line, respectively, and in line with belt planar center portion 26. Tension rollers 46 and 48 are also preferably supported for rotation in line and parallel to horizontal plane H.

The rollers can be formed of aluminum, plastic, composite material, or any other low density material. Preferably tension rollers 46 and 48 are made of aluminum and are less than 4.0 inches in diameter and less than 0.5 inches thick. Additionally, preferably tension rollers 46, 48 have an inertia less than about 1000 grams-cm$^2$. More preferably, tension rollers 46, 48 are less than 2.0 inches in diameter, less than 0.5 inches thick, and have an inertia less than 100 grams-cm$^2$. Idler Rollers 36, 42 and 40 are preferably made of plastic and are less than 1.50 inches in diameter and less than 0.5 inches thick, and have an inertia less than 100 grams-cm$^2$. Tension sensing rollers 38 and 44 are preferably made of aluminum and are less than 1.0 inch in diameter and less than 0.5 inches thick, and have an inertia less than 100 grams-cm$^2$.

In one preferred method of operation, low tension roller 46 provides about 50% of the applied tension to thread 34, while high tension roller 48 provides the remaining 50% of applied tension to thread 34. Preferably, low tension roller 46 is always engaged, or tensioning thread 34, while motor 12 is in operation. Also, during the initial or start-up period of winding, high tension roller 48 is preferably inoperative and the magnetic brake coupled thereto does not tension thread 34, so that thread 34 is wound onto the center 52 under relatively low tension regulated by the low tension roller 46. At a preselected time, high tension roller 48 is engaged and the magnetic brake coupled thereto acts to increase the rotational torque of high tension roller 48 and apply further tension to thread 34 as it passes over roller 48.

The instance of engagement of high tension roller 48 can be determined by timer 22 or by indicator 24, or by both. Where a timer 22 is used, the time after thread 34 starts winding about the golf ball core is monitored by the timer, and at a preselected time, the timer 22 generates a signal which is transmitted to high tension roller 48 to make it operative. Indicator 24 senses the diameter of the golf ball core. As the threads wind about the center 52, the size of the golf ball core diameter increases. When the golf ball core has reached a preselected diameter, indicator 24 generates a signal that is transmitted to magnetic brake 56 (as shown in FIG. 2) to put it into operation. It has been found that best results are achieved when both the timer 22 and indicator 24 are used. The timer and/or indicator can also be used to indicate when a golf ball core has been wound to a desired size.

The winding apparatus 5 can be used to wind numerous types of thread, such as high elongation elastomeric thread, high modulus low elongation fiber, or any material in the form of a continuous strand known to those skilled in the art. The winding apparatus 5 is preferably for use in winding threads with low breaking tension at production or high speeds, such as threads made from a spun material or polyether urea having a denier below about 2000. One example of such a thread is a 1680 denier S30 polyether urea thread available from Globe Manufacturing, Fall River, Mass. However, the invention is not limited thereto and numerous other threads may be used. Low breaking tension thread is defined herein as thread having a breaking tension less than about 800 grams.

The total tension of the thread is due to a combination of tension caused by inertial forces during acceleration, and tension applied due to the brakes. The inertial portion of total tension is due to inertial forces that are the product of rotational acceleration and rotary inertia. Low rotary inertia reduces thread tension during start up and hence failure of threads during the initiation of the ball winding process are eliminated or reduced. As a result, low breaking tension threads are wound more readily. Preferably, the tension due to rotary inertia is less than 10% of the desired total tension. For example, when winding with the 1680 denier S30 polyether urea thread mentioned above, if the desired total tension is 300 grams, tension due to rotary inertia should be less than 30 grams.

Preferably, the sum of the rotary inertias of the rotational members of the thread winding section is less than about 3000 grams-cm$^2$, about 1500 grams-cm$^2$, and more preferably less than about 800 grams-cm$^2$, most preferably about 200 grams-cm$^2$. Due to such a low rotary inertia, preferably the apparatus of the present invention takes about 1.5 to about 2 seconds to accelerate up to a winding velocity of 10 to 20 ft/s. In contrast, prior art winding apparatuses can take up to 5 seconds to accelerate up to full winding velocity.

Figure 3:
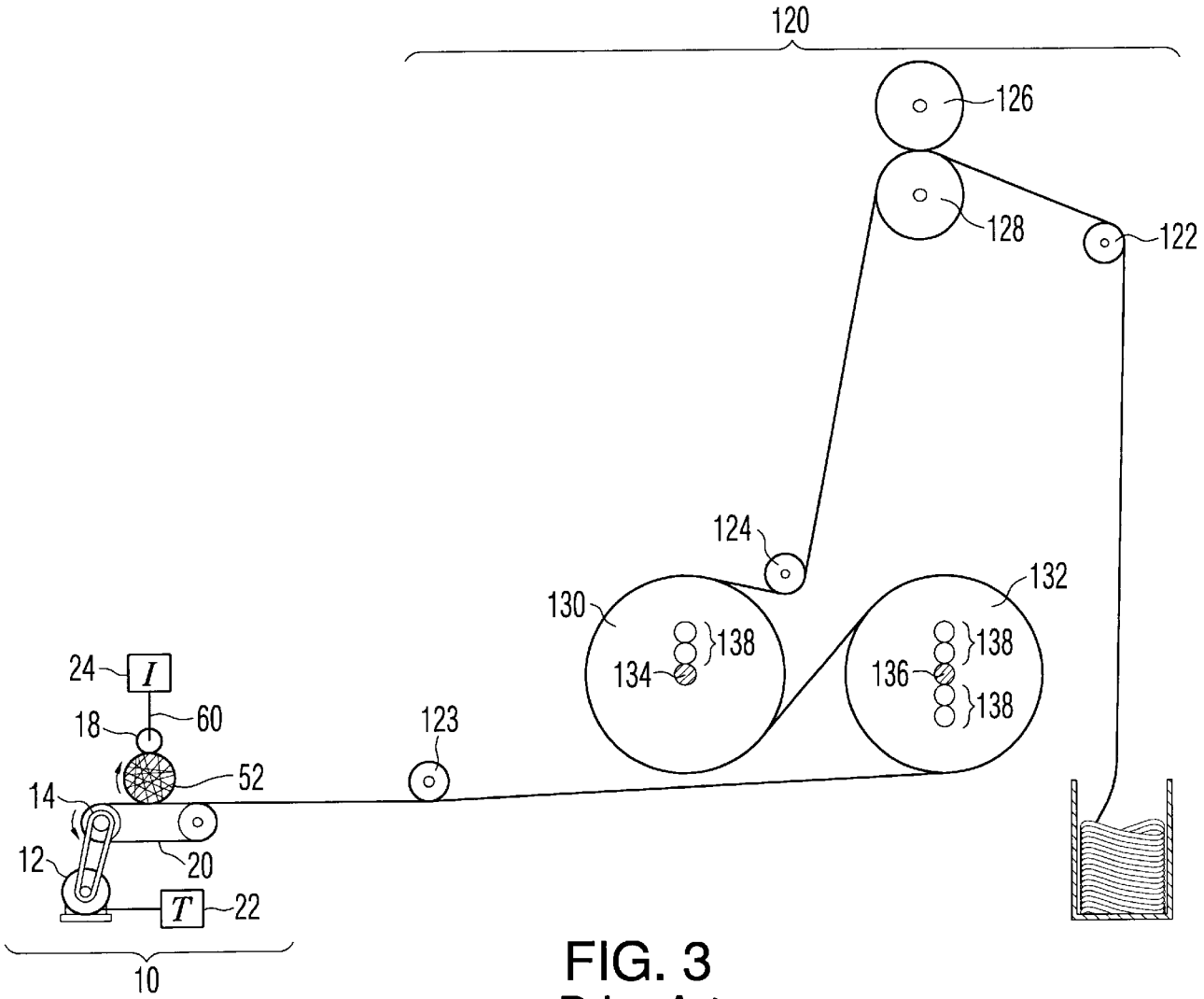
FIG. 3 Prior Art
FIG. 3 is a schematic view of a prior art winding apparatus.

FIG. 3 shows a schematic view of a prior art winding apparatus 100. Apparatus 100 has winding station 10 which is as discussed above and a thread feed section 120 which is modified. The thread feed section 120 of the prior art apparatus comprises idler rollers 122, 123, 124, nip rollers 126, 128, tension rollers 130, 132 and shafts 134, 136 attached thereto. Friction rollers 138 bear against shafts 134, 136 to brake tension rollers 130, 132.

These and other aspects of the present invention may be more fully understood with reference to the following non-limiting example shown in Table B, which is merely illustrative of the preferred embodiment of the present invention winding apparatus, and is not to be construed as limiting the invention, the scope of which is defined by the appended claims. The dimensions and configuration of the rotating members can be varied from those exemplified so that the desired low moment of inertia is achieved.

Table A shows the dimensions, materials and inertia values of the rotating parts employed in the apparatus 100 of the prior art (shown in FIG. 3).

The inertia of each rotating body may be obtained by using a testing machine or can be computed from the dimensions and materials from which they are made. The inertia values displayed in the above tables were obtained using a device from Intertia Dynamics, Inc. of Collinsville, Conn. with model number 5050.

Referring to the above tables, the winding apparatus of the present invention uses relatively small diameter rollers and shafts which are made from relatively low density materials to attain a low total rotary inertia. For example, prior art tension rollers are about 4 inches in diameter and idler rollers are about 2.125 inches in diameter, while tension rollers and idler rollers of the present invention have at least one diameter that is significantly less, about 50% of prior art diameter. Preferably, the density of the materials used for the inventive apparatus is below about 8 g/cm$^3$, more preferably below about 3 g/cm$^3$, most preferably below about 1.2 g/cm$^3$. In addition, as can be seen in FIG. 1, tension rollers 46 and 48 define holes 47 and 49, respectively, extending therethrough to further reduce the mass of the rollers used.

Figure 4:
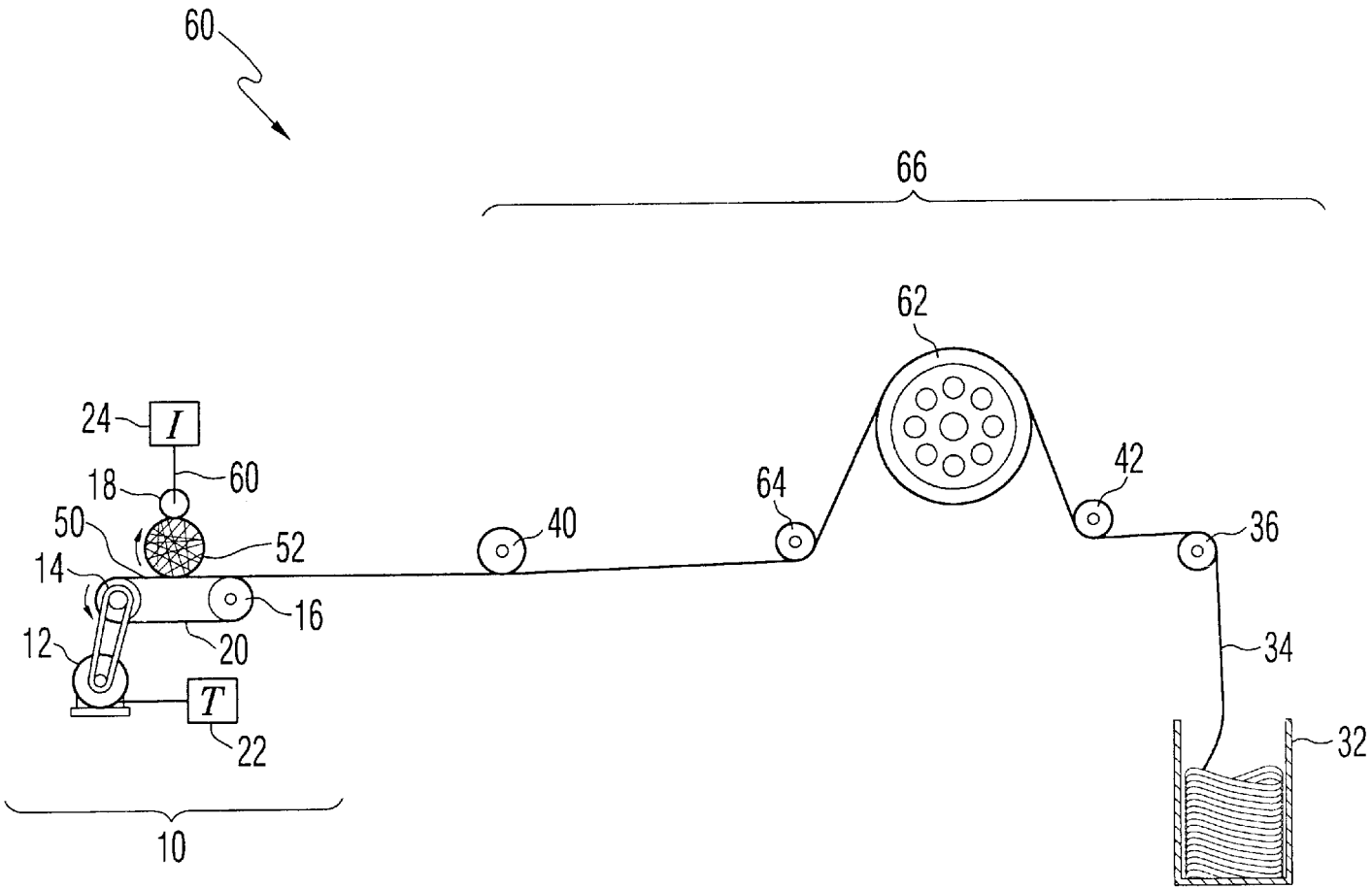
FIG. 4 is a schematic view of another embodiment of the golf ball winding apparatus according to the present invention.

In alternative embodiments, the number of tension rollers can be increased or decreased. Referring to another embodiment of a winding apparatus 60 in FIG. 4, only one tension roller 62 and one tension sensing roller 64 are used. A tensioning device (not shown), such as a permanent magnetic or electro-magnetic brake, as described in the previous embodiments, is preferably associated with the tension roller 62 to apply tension to the thread. Since fewer rotating members are used, an even lower total inertia of the rotating members of the winding section 66 may be obtained. For example, utilizing similar components for corresponding rotating members as described in the previous embodiment, a total inertia below about 140 grams-cm$^2$ can be obtained.

TABLE A

Prior Art Winding Apparatus

| Quantity | Component | Component Dimensions | Material | Inertia (grams-cm$^2$) |
|---|---|---|---|---|
| 2 | Tension Rollers (130, 132) | 4.25" diameter × 0.375" thick | Cast Iron | 3486.33 |
| 2 | Idler Rollers (122, 124) | 2.125" diameter × 0.75" thick | Rubber and Steel | 399.80 |
| 2 | NIP Rollers (126, 128) | 1.375" diameter × 0.5" thick | Plastic | 43.57 |
| 2 | Shafts (134, 136) | 0.25" diameter × 3.5" (in length) | Steel | 5.68 |
| Total Inertia = | | | | 3929.70(grams-cm$^2$) |

Table B shows the dimensions, materials and inertia values of the rotating parts employed in the apparatus 5 of the present invention (shown in FIG. 1).

TABLE B

Present Invention Winding Apparatus

| Quantity | Component | Component Dimensions | Material | Inertia (grams-cm$^2$) |
|---|---|---|---|---|
| 1 | Low Tension Roller (46) | 2.0" diameter × 0.250" thick | Aluminum | 64.71 |
| 1 | High Tension Roller (48) | 2.0" diameter × 0.250" thick | Aluminum | 63.86 |
| 2 | Idler Rollers (36, 42) | 1.25" diameter × 0.375" thick | Plastic | 43.57 |
| 2 | Tension Sensing Rollers (38, 44) | 0.75" diameter × 0.25" thick | Aluminum | 3.85 |
| 2 | Shafts (58) | 0.375" diameter × 1.75" long | Steel | 2.24 |
| Total Inertia = | | | | 178.23 (grams-cm$^2$) |

In the alternative, other embodiments having three or more tension rollers in the winding section can also be used. Each tension roller is preferably associated with a tensioning device, such as the magnetic brakes described for other embodiments. The total inertia of the rotating members of the winding section is preferably below about 3000 grams-$cm^2$, more preferably below about 1500 grams-$cm^2$, more preferably still less than about 800 grams-$cm^2$, most preferably about 200 grams-$cm^2$ The apparatus and method of the present invention is particularly useful in winding thread of the type disclosed in U.S. patent application Ser. No. 09/610,606, filed on even date, entitled "Multiple Thread GolfBall" to Halko et al., which is incorporated by reference herein in its entirety. Also, the apparatus and method of the present invention is useful in making golf balls of the type disclosed in U.S. patent application Ser. No. 09/610,608, filed on even date herewith, entitled "Golf Balls with a Fused Would Layer and a Method for Forming Such Balls" to Bissonnette et al., which is incorporated by reference herein in its entirety.

While it is apparent that the illustrative embodiments of the invention herein disclosed fulfill the objectives stated above, it will be appreciated that numerous modifications and other embodiments may be devised by those skilled in the art. The embodiments above can also be modified so that some features of one embodiment are used with the features of another embodiment. In addition, one embodiment may have more or less idler rollers, tension rollers, and sensing rollers. Therefore, it will be understood that the appended claims are intended to cover all such modifications and embodiments which come within the spirit and scope of the present invention.

We claim:

1. A winding apparatus for winding a thread on a golf ball center, comprising:

a golf ball center winding station for winding a golf ball center;

a plurality of rotating members spaced from the winding station and supported for rotation and for guiding the thread to the winding station and for tensioning the thread, wherein each rotating member has a rotational inertia and a sum of the rotational inertias of the rotating members is less than about 3000 grams-$cm^2$.

2. The apparatus of claim 1, wherein the sum of the rotational inertias of the rotating members is less than about 1500 grams-$cm^2$.

3. The apparatus of claim 1, wherein the sum of the rotational inertias of the rotating members is less than about 800 grams-$cm^2$.

4. The apparatus of claim 3, wherein the plurality of rotating members includes at least one tension roller and a tensioning device is operatively associated with at least one tension roller for elongating the thread, wherein the tensioning device is selected from one of the group that includes a permanent magnet, an electro-magnet or both.

5. The apparatus of claim 1, wherein the sum of the rotational inertias of the rotating members is less than about 200 grams-$cm^2$.

6. The apparatus of claim 1, wherein the plurality of rotating members includes at least one tension roller and a tensioning device is operatively associated with at least one tension roller for elongating the thread.

7. The apparatus of claim 6, wherein the tensioning device comprises a friction brake.

8. The apparatus of claim 6, wherein the tensioning device comprises a second roller adjacent the tension roller and configured and disposed to compress the thread between the tension roller and second roller, wherein the tension roller is rotated at a first speed and the second roller is rotated at a second speed, and the first speed is different than the second speed to elongate the thread.

9. The apparatus of claim 6, wherein the tensioning device comprises a magnetic brake.

10. The apparatus of claim 9, wherein the magnetic brake includes a permanent magnet.

11. The apparatus of claim 9, wherein the magnetic brake includes a electro-magnet brake.

12. The apparatus of claim 6, wherein the at least one tension roller includes first and second tension rollers, the second tension roller associated with a second tensioning device for elongating the thread.

13. The apparatus of claim 12, wherein each tension roller has an axis of rotation and each axis of rotation is in line and parallel to a horizontal plane.

14. The apparatus of claim 12, wherein the tension rollers are made of a material with a density less than about 8 g/$cm^3$.

15. The apparatus of claim 12, wherein the tension rollers are less than about 4.0 inches in diameter and less than about 0.5 inches thick.

16. The apparatus of claim 12, wherein the plurality of rotating members further includes at least one idler roller.

17. The apparatus of claim 16, wherein each idler roller is made of a material with a density less than about 3 g/$cm^3$.

18. The apparatus of claim 17, wherein the idler rollers are less than about 1.5 inches in diameter and less than about 0.5 inches thick.

19. The apparatus of claim 16, wherein the plurality of rotating members further includes at least one sensing roller.

20. A winding apparatus for winding a thread on a golf ball center, comprising:

a golf ball center winding station for winding a golf ball center;

a plurality of rotating members spaced from the winding station and supported for rotation and for guiding the thread to the winding station and for tensioning the thread, the rotating members including at least one tension roller and a tensioning device is operatively associated with at least one tension roller, said tension device includes a magnetic brake that applies a non-frictional torque to at least one tension roller.

21. A method of winding a golf ball comprising the steps of:

providing a golf ball center;

winding a thread onto the golf ball center over at least one roller;

applying tension to the thread before winding on the center; and changing the tension by applying a magnetically induced torque to at least one roller such that the torque is non-frictional with respect to the associated roller;

wherein the step of applying tension further includes providing a first brake and a second brake, wherein the first break is always operative and the second brake is selectively operative.

22. The method of claim 21, wherein the step of changing the tension includes using a magnetic brake.

23. The method of claim 21, wherein the thread has a breaking tension below about 800 grams.

* * * * *